US006922854B2

(12) United States Patent
Allenbaugh et al.

(10) Patent No.: US 6,922,854 B2
(45) Date of Patent: Aug. 2, 2005

(54) AIR-BURST DRAIN PLUNGER

(75) Inventors: Howard M. Allenbaugh, Huntington Beach, CA (US); David M. Turchik, Corona, CA (US); Gerard G. Adelmeyer, Dana Point, CA (US)

(73) Assignee: The Howard and Veronica Allenbaugh Family Trust, Huntington Beach, CA (US)

( * ) Notice: Subject to any disclaimer, the term of this patent is extended or adjusted under 35 U.S.C. 154(b) by 0 days.

(21) Appl. No.: 10/420,109

(22) Filed: Apr. 21, 2003

(65) Prior Publication Data

US 2004/0016048 A1 Jan. 29, 2004

Related U.S. Application Data

(63) Continuation-in-part of application No. 10/202,430, filed on Jul. 23, 2002, now Pat. No. 6,550,074.

(51) Int. Cl.[7] ..... E03D 11/00

(52) U.S. Cl. ..... 4/255.11; 4/255.01; 4/255.04; 4/255.05

(58) Field of Search ..... 4/255.01, 255.04, 4/255.05, 255.06, 255.11; 15/406; 141/329

(56) References Cited

U.S. PATENT DOCUMENTS

| | | | | |
|---|---|---|---|---|
| 2,300,319 A | | 10/1942 | Smith | |
| 2,626,404 A | | 1/1953 | Marks | |
| 2,939,154 A | | 6/1960 | Gasser | |
| 2,999,264 A | | 9/1961 | Stearns | |
| 3,138,803 A | | 6/1964 | Caplan et al. | |
| 3,189,934 A | | 6/1965 | Steinwedel | |
| 3,280,419 A | | 10/1966 | Frohlich | |
| 3,315,280 A | | 4/1967 | Krenn | |
| 3,879,771 A | | 4/1975 | Nakane | |
| 4,059,858 A | | 11/1977 | Lambel et al. | |
| 4,063,317 A | | 12/1977 | Santore | |
| 4,097,937 A | | 7/1978 | Hofmann | |
| 5,239,708 A | | 8/1993 | Irwin | |
| 5,249,311 A | | 10/1993 | Rau | |
| 5,666,690 A | * | 9/1997 | Domansky | 15/406 |
| 5,669,099 A | | 9/1997 | Porcasi | |
| 5,803,101 A | | 9/1998 | Gallo | |
| 5,996,597 A | | 12/1999 | Gallo | |
| 6,032,301 A | | 3/2000 | Wang | |
| 6,035,455 A | | 3/2000 | Rankovic | |
| 6,550,074 B1 | | 4/2003 | Allenbaugh et al. | |

OTHER PUBLICATIONS

Operating Instructions for Kinetic Water Ram, McMaster–Carr, p. 1762, Maintenance Warehouse, p. 739, Aug. 7, 1999.

(Continued)

*Primary Examiner*—Khoa D. Huynh
(74) *Attorney, Agent, or Firm*—Knobb, Martens, Olson & Bear, LLP

(57) ABSTRACT

An affordable plumbing device that uses a compressed gas and a burst disk having a relatively even surface of substantially uniform thickness to produce a sudden discharge of energy to forcibly act against any obstruction that may interfere with the proper function of a drain. The plumbing device has a cylindrical chamber for receiving the compressed gas and may generally take the shape of a plunger, which is flexible to use and is easy to store. A portion of the chamber forms a receiving chamber with the burst disk for harnessing and directing the energy of the compressed gas to clear the drain.

24 Claims, 15 Drawing Sheets

OTHER PUBLICATIONS

McMaster–Carr, Catalogue 108, 2002.
Kyna–Colt operating instructions, McMaster Carr, p. 1762, 1995.
Original Pressure Plumber, McMaster–Carr, p. 1762.
Maintenance Warehouse, Catalog vol. 49.
Instructions for the "Mama's Plumber", Marco Products Company.
Yidatong Pump Air Plunger, www.airplunger.com, Sep. 4, 2002.
Pending PCT application PCT/US03/12315 filed Apr. 21, 2003.
International Search Report for PCT/US 03/12315 filed Apr. 21, 2003.

* cited by examiner

AIR-BURST DRAIN PLUNGER

CROSS-REFERENCE TO RELATED APPLICATION

This application is a continuation-in-part of application Ser. No. 10/202,430, filed Jul. 23, 2002 now U.S. Pat. No. 6,550,074, which is hereby incorporated by reference in its entirety.

BACKGROUND OF THE INVENTION

1. Field of the Invention

The present invention generally relates to plumbing devices used to clear drains and, more specifically, to a plumbing device that uses a compressed gas to provide a sudden burst of energy to forcibly act against an obstruction that may interfere with the proper function of a drain.

2. Description of the Related Art

Clogged drains are a problem that affects millions of households and businesses each year. It is a situation that often occurs due to obstructions along the flow path of the drain by items such as paper, soap residue, hair, lotion, and stringy, fibrous waste. While there are a number of plumbing devices that offer the promise of unstopping or unclogging drains, none offer the ability to clear a clogged pipe with the efficiency, ease, affordability, and force of the present invention.

When a drain becomes clogged, there are a number of known approaches for clearing the obstruction. One of the most common methods of treating clogged drains is to use a commercial drain cleaner. However, often these drain cleaners are some of the most dangerous chemicals found in a home or business. For instance, these products commonly use lye or acid, which can harm health, the wastewater stream, and pipes.

While there are alternatives to commercial drain cleaners, the effectiveness of these alternatives generally requires an appreciable amount of manual force or the sacrifice of flexibility and mobility. For instance, some devices use a simple force cup plunger, or a bellows-style plunger, to open a clogged sink drain by repeatedly pumping the plunger up and down directly over the clogged drain. While these plungers avoid the caustic chemicals associated with drain cleaners, they are generally less effective and require a significant amount of manual labor. As one may appreciate, the need to pump the plunger in a repetitive manner may cause a person to become quite exhausted and, indeed, may be beyond the ability of some individuals. In addition, depending on the size or number of obstructions, the use of manual labor may not be sufficient to dislodge the obstruction from the drain.

There are some plungers that contemplate the use of a compressed gas to forcibly remove obstructions clogging a drain. These compressed gas plungers, however, are relatively expensive and may be unaffordable to many individuals or households. In addition, while such plungers may not require the same amount of manual labor as a simple force cup plunger or a bellows-style plunger, existing compressed gas plungers generally do not harness and effectively release all of the available energy provided by the pressurized gas.

It has been proposed that using a sudden burst of gas pressure is a preferable way to clear a clogged drain. However, plumbing devices that employ this method are often bulky and generally take a form different from a traditional plunger, which can make such devices difficult to use and inconvenient to store. In addition, the size and shape of these devices limits the flexibility of their use in a number of different but common plumbing scenarios, such as a clogged toilet, stopped tub, and a clogged sink drain, particularly in tight quarters or where space is limited. Furthermore, some of these devices use a scored sheet metal diaphragm, or a metal disk having a non-uniform thickness, for storing a predetermined quantity of gas and releasing the gas automatically at a predetermined pressure. These metal disks generally require additional manufacturing steps which result in higher costs.

Accordingly, there is a need for a plumbing device that rapidly and effectively clears obstructed drains, that is environmentally friendly, and does not require the use of harsh chemicals. In addition, there is a need for a plumbing device that is easy to use, does not require a significant amount of manual labor, and is relatively inexpensive to manufacture. Furthermore, there is a need for a plumbing device in the form of a plunger that harnesses the energy of a compressed gas and efficiently directs the gas's energy in a sudden burst to expel an obstruction in a clogged drain. The present invention satisfies these and other needs and provides further related advantages.

SUMMARY OF THE INVENTION

The present invention is embodied in an air-burst drain plunger that uses a compressed gas to provide a sudden burst of energy to forcibly act against an obstruction that may clog or otherwise interfere with the proper function of a drain.

In one embodiment, the air-burst drain plunger comprises a chamber for receiving a compressed gas, and a sealing member for providing a secure connection between the chamber and a drain opening. A burst disk constructed from a substantially non-metallic material is positioned to create a barrier between the chamber and sealing member. The burst disk has a substantially smooth surface and is adapted to burst when the pressure in the chamber reaches a predetermined level. The thickness of the burst disk may be calibrated to immediately burst when the pressure in the chamber reaches the predetermined level.

In another embodiment, the plunger comprises a burst disk of substantially uniform thickness and a chamber having an upper and lower end. The burst disk is positioned between the upper and lower end for creating a barrier within the chamber. While the lower end of the chamber is connected to a sealing member for securing the plunger to an opening in the drain, the upper end of the chamber is connected to a handle. The handle has at least one trigger for allowing a pressurized gas to enter into the inner cavity.

In another embodiment, the plunger comprises a chamber, a handle, and a burst disk. The chamber is designed to receive a compressed gas and has an upper end and a lower end. The lower end is connected to a sealing mechanism for securing the plunger to an opening in the drain. The handle is connected to the upper end of the chamber and has an area adapted to receive a pressurized gas cartridge having a puncture point. The handle has a trigger that, when activated, allows for the handle to travel toward the chamber, puncture the cartridge, and allow pressurized gas to enter the inner cavity. The burst disk separates the chamber from the sealing mechanism and creates a barrier. The burst disk is adapted to burst when the pressurized gas enters the chamber.

In another embodiment, the plunger comprises a chamber, a nozzle, and a burst disk. The chamber has an upper end and a lower end. The upper end of the chamber is designed to receive a nozzle having a piercing pin for puncturing a pressurized gas cartridge housed in a cover, which can be attached to the upper end of the chamber. The cover is designed in such a manner that when the cover is forced to move axially toward the chamber, the piercing pin punctures the gas cartridge allowing gas to escape therefrom and travel through an air inlet in the pin and into the nozzle. The nozzle has at least one passage that directs the gas into the upper chamber wherein the burst disk is adapted to rupture when the pressure of chamber's inner cavity reaches a predetermined level.

Other features and advantages of the present invention will become apparent from the following detailed description of the preferred embodiments, taken in conjunction with the accompanying drawings, which illustrate, by example, the principles of the invention.

BRIEF DESCRIPTION OF THE DRAWINGS

The accompanying drawings are intended to provide further understanding of the present invention and are incorporated in and constitute a part of this specification. The drawings illustrate embodiments of the present invention and together with the description serve to explain the principles of the invention.

DETAILED DESCRIPTION OF THE PREFERRED EMBODIMENT

Figure 1:
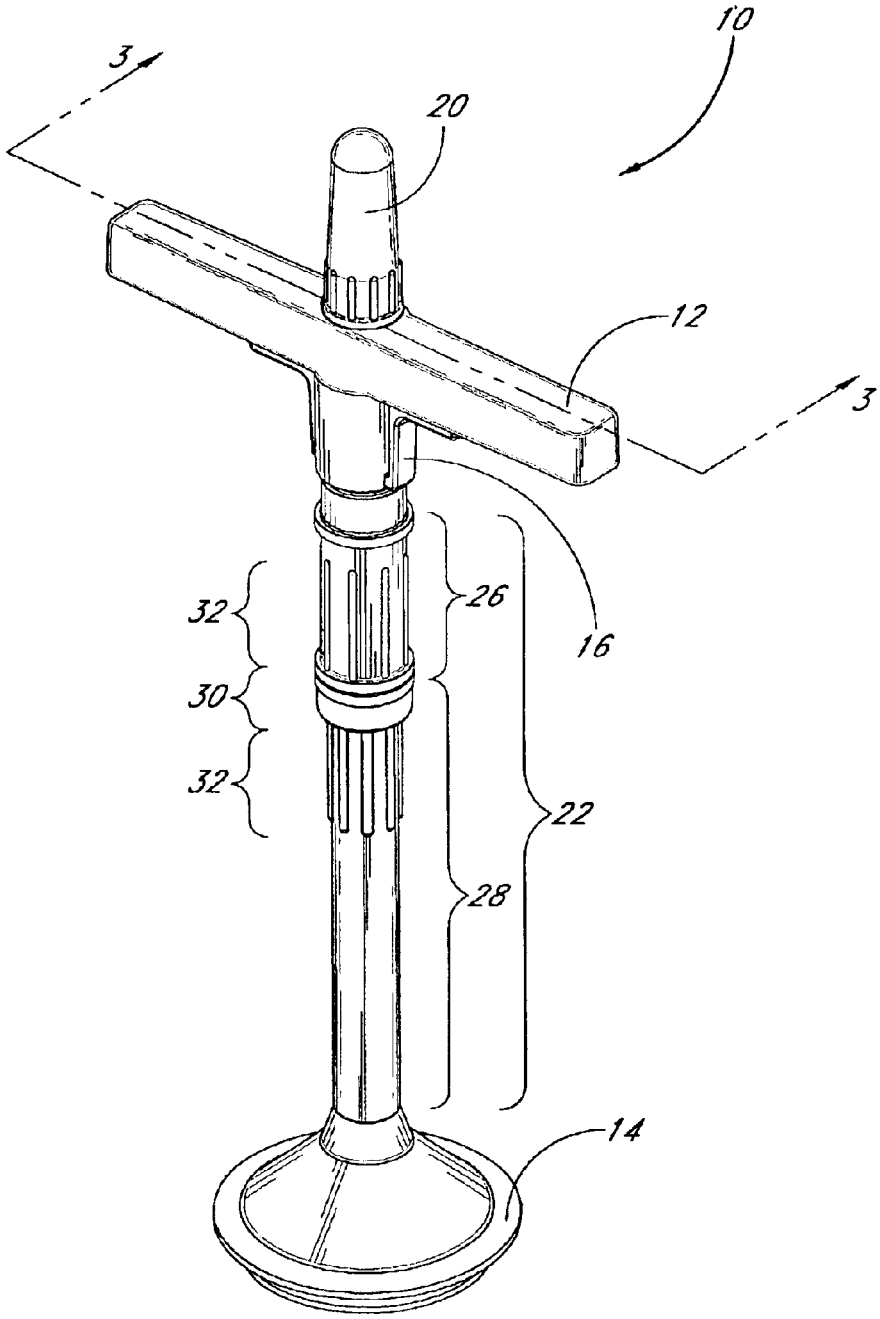
FIG. 1 is a perspective view of an air-burst drain plunger having a handle for gripping and positioning the plunger and a reversible sealing member for providing communication between the plunger and a drain.

As shown in the drawings, the present invention is embodied in an air-burst drain plunger, generally referred to by the reference numeral 10, for clearing a drain or pipe. The plunger 10 is designed to harness the energy from a compressed gas and propel the gas to an obstruction point along a clogged drain, using the energy of the gas to forcibly remove the obstruction without the need for excessive manual labor. The following is a detailed description of the preferred embodiment, as shown in FIG. 1, having a handle 12 for gripping and positioning the plunger 10, a reversible sealing member 14 for providing a connection between the plunger and a drain (not shown), and security triggers 16 for the safe operation of the plunger.

The handle 12 is preferably injection-molded and made from a polymer. However, as one skilled in the art can appreciate, the handle 12 may be composed of any suitable material such as a composite, metal or ceramic. While the sealing member 14 is preferably a flexible molded rubber cup, the sealing member may have any suitable shape and composition so long as a secure communication between the plunger 10 and the drain is achieved. The sealing member 14 preferably accommodates standard drain openings ranging from about 1 inch to about 4 inches in diameter, however, as one in the art can appreciate, the plunger 10 can accommodate sealing members of other sizes.

Figure 2:
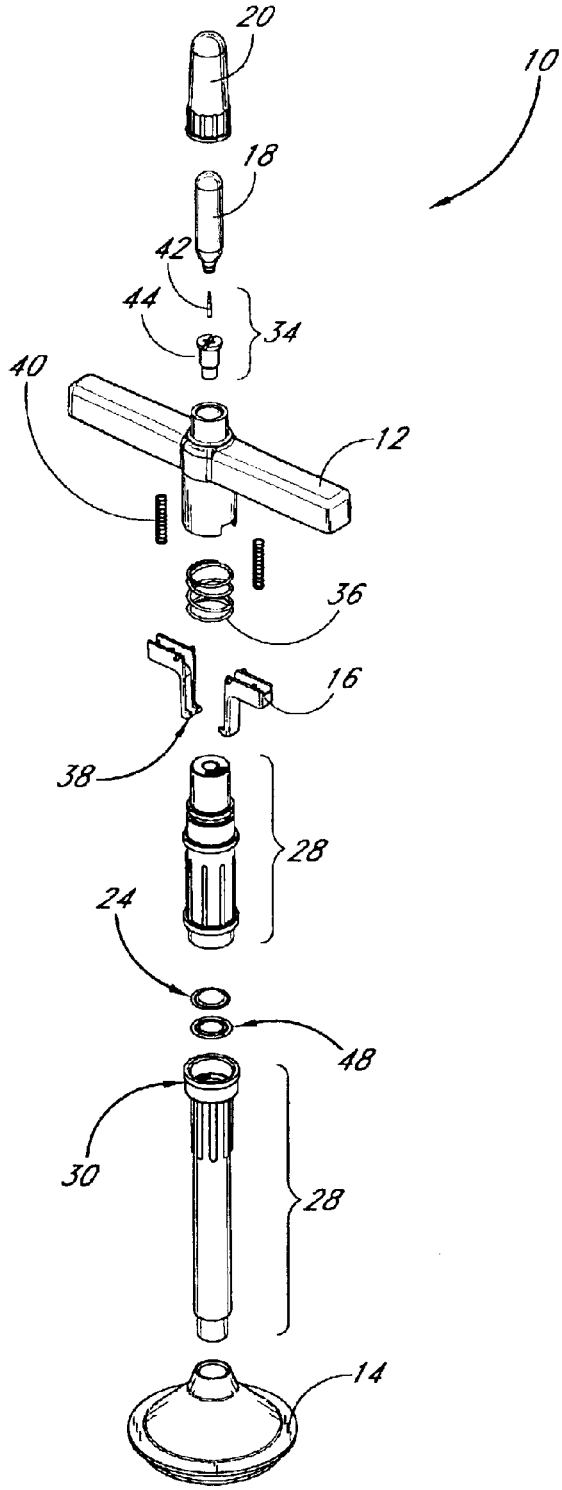
FIG. 2 is an assembly view of the plunger of FIG. 1.
Figure 3:
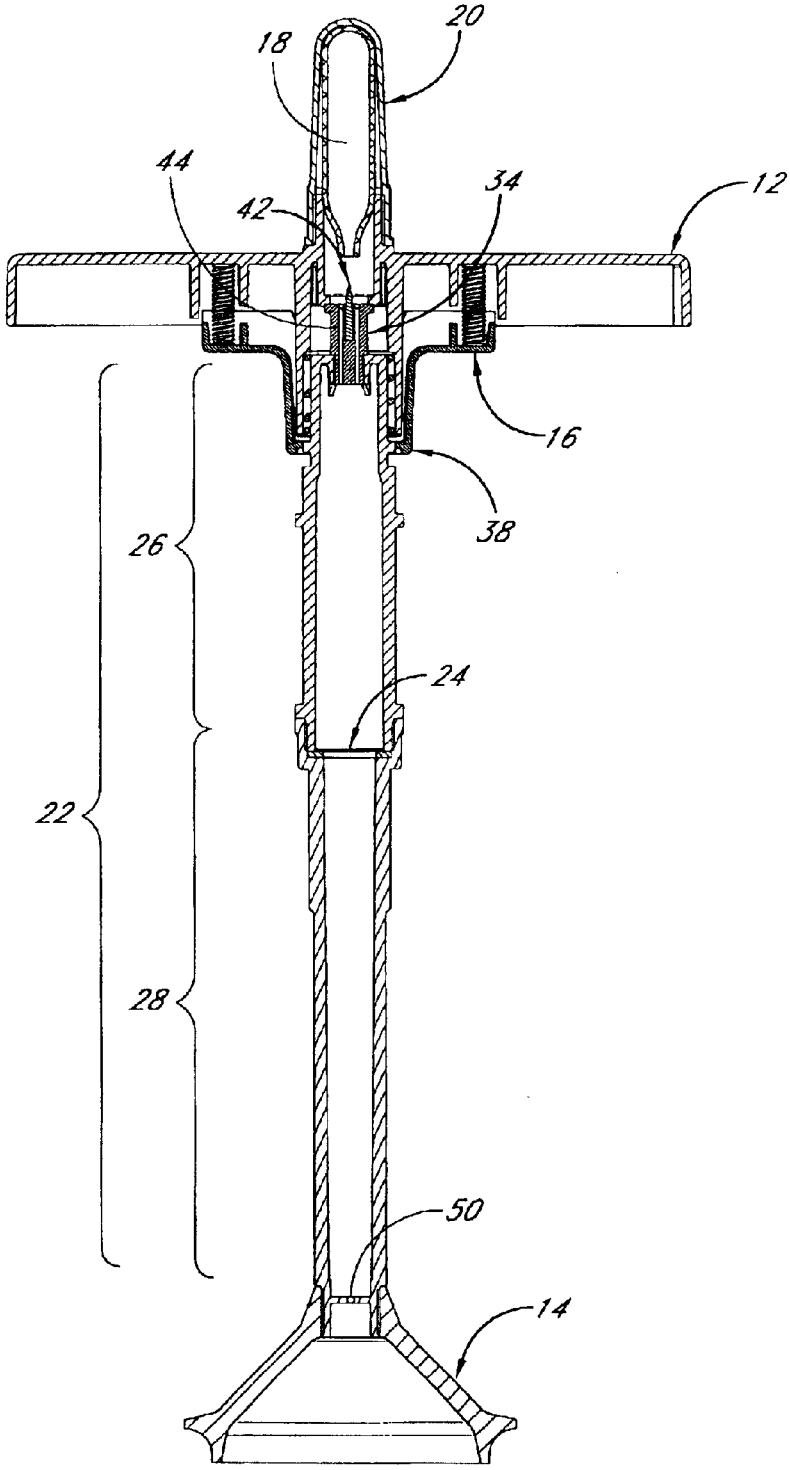
FIG. 3 is a cross-sectional elevation view of the plunger, taken substantially along section plane 3—3 of FIG. 1, showing a canister of compressed gas aligned with the longitudinal axis of the plunger, and an upper and lower chamber for receiving and channeling the force of the gas through the plunger.

In addition to the handle 12, sealing member 14, and security triggers 16, the preferred embodiment is further comprised of a compressed gas canister 18, generally housed within a cover 20 which is connected to the handle 12. The plunger 10 further comprises a hollow chamber 22 divided by a burst disk 24 into an upper chamber 26 and a lower chamber 28, as shown in FIGS. 2 and 3.

The gas canister 18 is preferably a small 12 g disposable metal-case compressed air ($CO_2$) cartridge pressurized at about 500 to 900 psi. Similar cartridges are commercially available from hardware retailers throughout the United States, such as Wal-Mart Stores in Los Angeles, Calif., under the brand name Crossman. The canister 18 can be any suitable $CO_2$ cartridge, or other suitable type of gas cartridge, that is capable of fitting within the cover 20, but is preferably a canister having a length that provides for an installed axial clearance of approximately a quarter of an inch (¼") with the nozzle piercing pin (discussed below). In addition, as one skilled in the art can appreciate, while the use of a compressed gas canister 18 is contemplated for the preferred embodiment, the plunger 10 could be connected to any suitable source, other than a canister, for delivering a compressed gas into the chamber 22. For example, the compressed gas could be delivered from a source external to the plunger 10 by a hose or other line.

Figure 15:
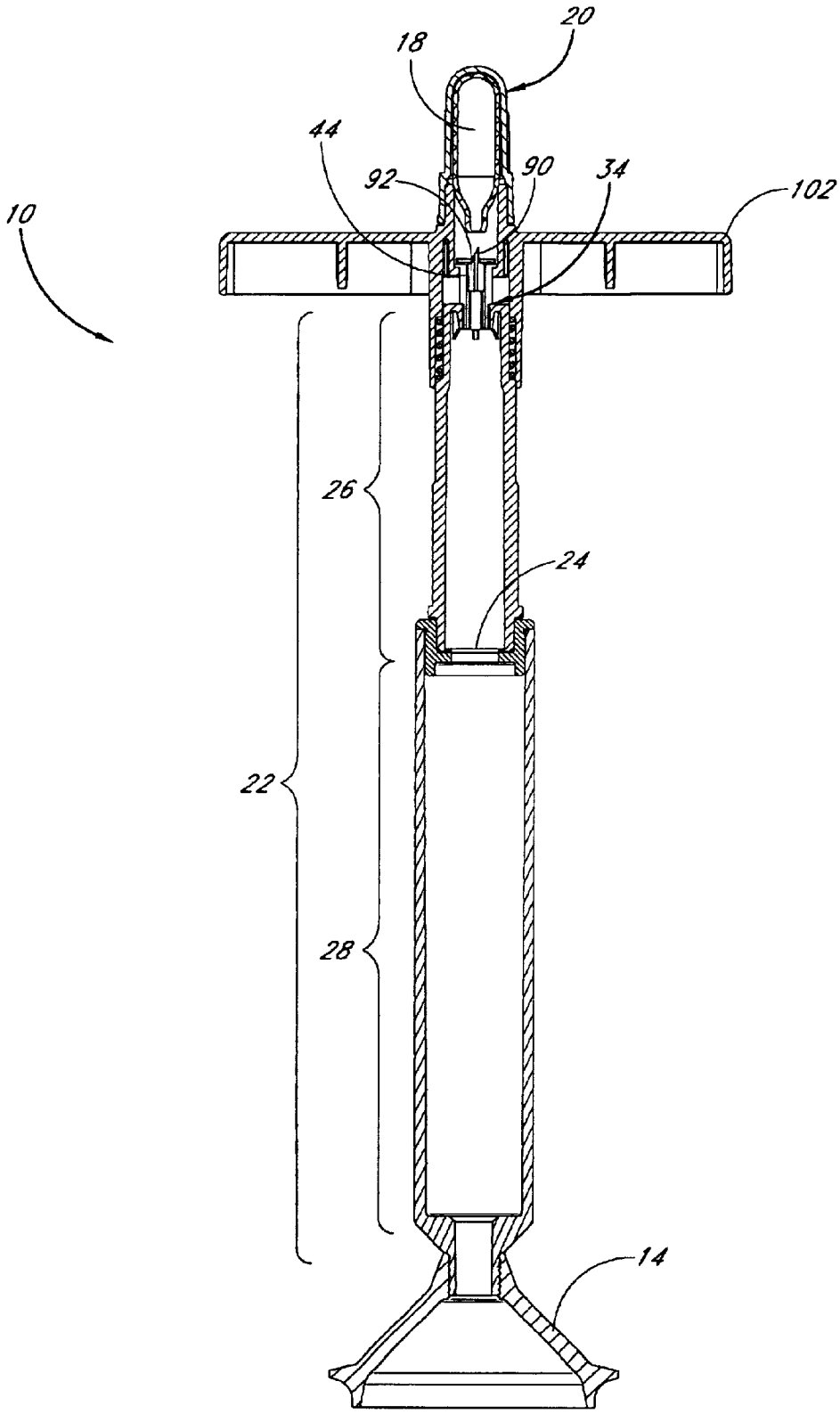
FIG. 15 is a cross sectional elevation view of the plunger, taken substantially along section plane 15—15 of FIG. 13, showing a canister of compressed gas aligned with the longitudinal axis of the plunger, and an upper and lower chamber for receiving and channeling the force of the gas through the plunger.

Alternatively, the gas canister 18 may be a smaller 8 g disposable metal-case compressed air ($CO_2$) cartridge pressurized at about 900 psi. This cartridge has a smaller internal volume than the preferred embodiment, which helps to reduce the discharge pressure of the canister and reduce the risk of back splash when the plunger 10 is in operation. A smaller version of the cover 20 may be used when the smaller 8 g cartridge is installed in the plunger 10, as shown in FIG. 15. The smaller version of cover 20 may be sized to provide for the same preferred axial clearance between the canister and the nozzle, as described in the previous paragraph, when the 8 g cartridge is installed. This smaller cover 20 also helps to control costs and improves the efficiency of manufacturing the plunger 10.

The cover 20 is preferably injection-molded and made from a polymer capable of securing the canister 18 to the plunger 10 and preventing the canister from exploding away when the plunger is in operation. However, one skilled in the art can appreciate that the cover 20 may be composed of any suitable material such as a composite, metal, or ceramic. A good connection between the cover 20 and handle 12 is important to provide a stable encasing for the canister 18 and limit air leakage during operation of the plunger 10. While any suitable fastener may be used to connect the cover 20 to the handle 12, such as brackets or clips, the cover is preferably attached to the handle by a threaded connection.

The lower chamber 28 is preferably a cylindrical body that may be joined to either end of the sealing member 14 by a threaded connection or interference fit. The upper chamber 26, which also is preferably a cylindrical body, is designed to connect with the handle 12 such that the handle can move axially a limited distance relative to the chamber. The two chambers 26, 28 are preferably attached to each other by a threaded connection along a flange 30. The flange 30 provides for access to and replacement of the burst disk 24. The chambers 26, 28 are preferably injection-molded and made from a polymer, however, one skilled in the art can appreciate that the chambers may be composed of any suitable material such as metal or ceramic. In addition, the chambers 26, 28 preferably have raised axial ribs 32 to improve grip during manual assembly and disassembly of the two chambers.

The size of the upper chamber 26 is designed to accumulate a sufficient volume of compressed gas, before the burst disk 24 ruptures, to provide sufficient force to dislodge most drain obstructions. The size of the lower chamber 28 is designed to deliver the compressed gas to the drain opening, once the burst disk 24 ruptures, without unnecessary dissipation of the energy. In the preferred embodiment, the upper chamber 26 has a volume of about 3.3 cubic inches. The lower chamber 28 in the preferred embodiment has a volume of about 2.5 cubic inches.

In an alternative embodiment, the lower chamber 28 has a larger volume than that of the upper chamber as represented in FIG. 15. The lower chamber 28 of FIG. 15 has a volume of about 18.1 cubic inches, a length of approximately 9.0 inches, and an exterior diameter of approximately 1.9 inches. The larger internal volume of this alternative embodiment of chamber 28 helps to reduce the discharge pressure from the upper chamber 26 before the energy of the compressed gas is propelled out from the sealing member 14. In addition, the alternative embodiment of chamber 28 helps to significantly reduce the potential of back splash of standing water during operation of the plunger.

Figure 4A:
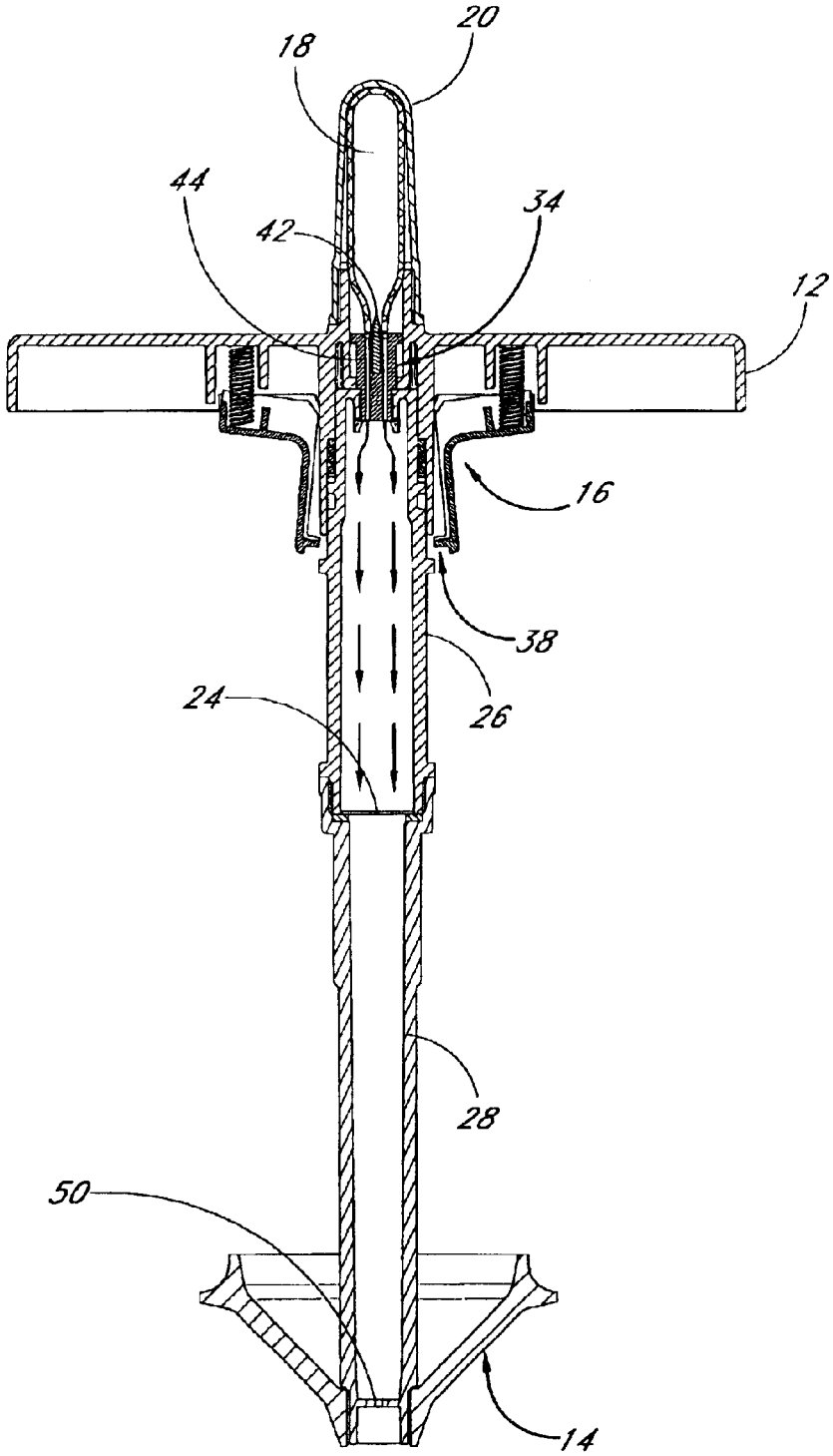
FIG. 4A is a cross-sectional elevation view of the plunger, similar to FIG. 3, wherein the sealing member is reversed, the handle is depressed, and the canister is ruptured by a nozzle pin, wherein the compressed gas is shown escaping into the upper chamber of the plunger.
Figure 4B:
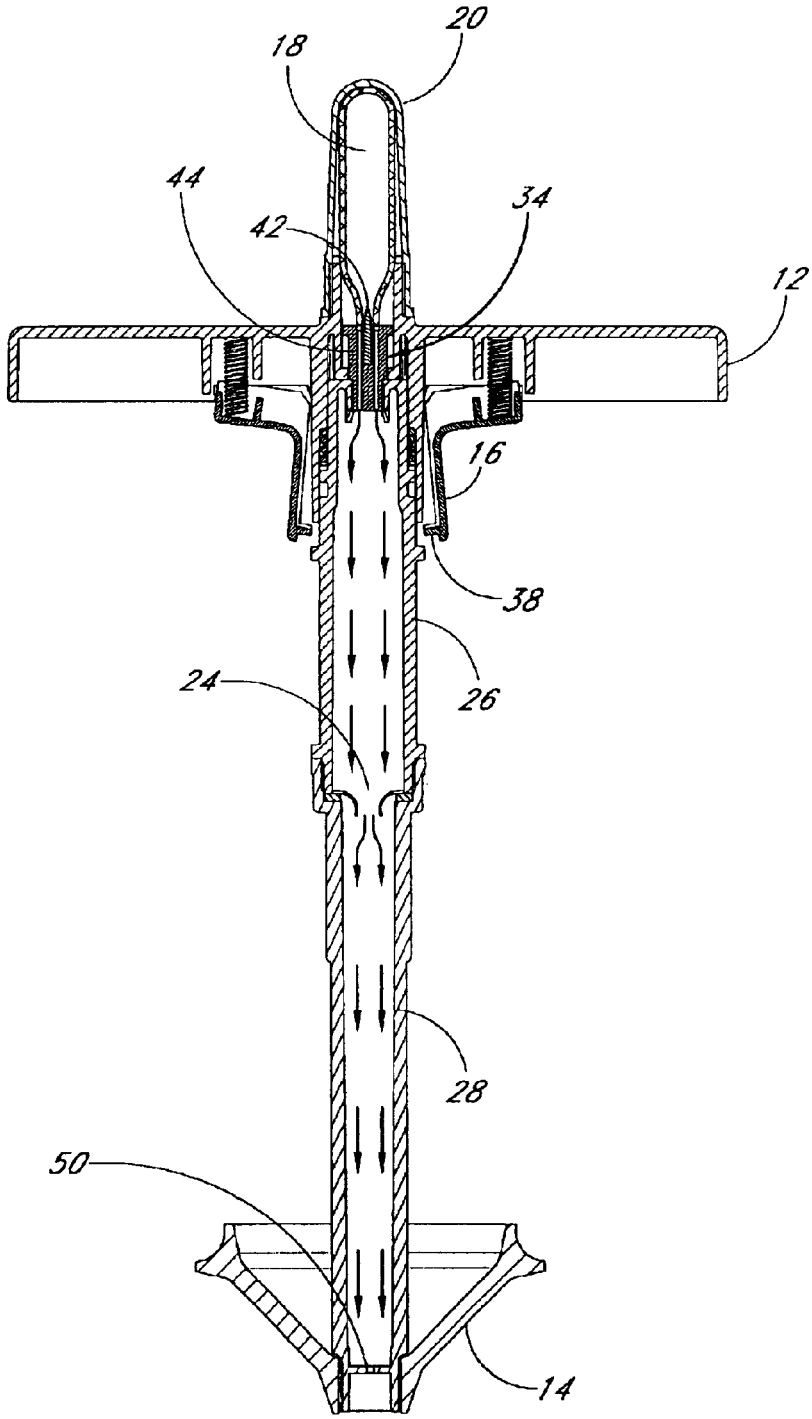
FIG. 4B is a further cross-sectional elevation view of the plunger, similar to FIG. 4A, wherein a burst disk separating the upper and lower chambers is ruptured and the force of the gas is released from the upper chamber and out through the lower chamber.

When the handle 12 is depressed toward the chamber 22, as shown in FIGS. 4A and 4B, a nozzle 34 connected to the upper end of the upper chamber 26 is adapted to pierce through the canister 18 so as to permit the rapid discharge of the compressed gas from the canister into the upper chamber. Preferably, a compression spring 36 is nestled between the handle 12 and the upper chamber 26 to normally bias the handle away from the upper chamber and, thus, provide a space or clearance between the lower end of the canister 18 and the upper end of the nozzle 34. In this way, the spring 36 helps prevent the unintended rupture of the canister 18.

As shown in FIGS. 2 and 3, optional security triggers 16 may be provided along the connection between the handle 12 and the upper chamber 26. These security triggers 16 help to provide further protection against the unintended rupture of the canister 18. The security triggers 16 are designed to restrict axial movement of the handle 12 by positive stops 38 obstructing the downward travel path of the handle. The position of the positive stops 38, as shown in FIG. 3, is maintained by the urging of compression springs 40 on the security triggers 16. The travel path of the handle 12 may be freed by manually compressing the security triggers 16 toward the handle so that the positive stops 38 pivot or rotate away from the travel path, as shown in FIGS. 4A and 4B. The security triggers 16 may be secured to the handle using snap-fit protrusions.

The security triggers 16 are also designed and configured on the preferred embodiment to require the use of two hands when operating the plunger 10, which forces the operator to position both hands on the handle away from the wastewater or drain. The application of a downward force with both hands, which is necessary to cause the release of the compressed gas from the canister 18, also helps assure a good surrounding seal between the sealing member 14 and the drain opening. Assuring a good seal reduces the risk of back splash of standing water during operation of the plunger 10.

Figure 19:
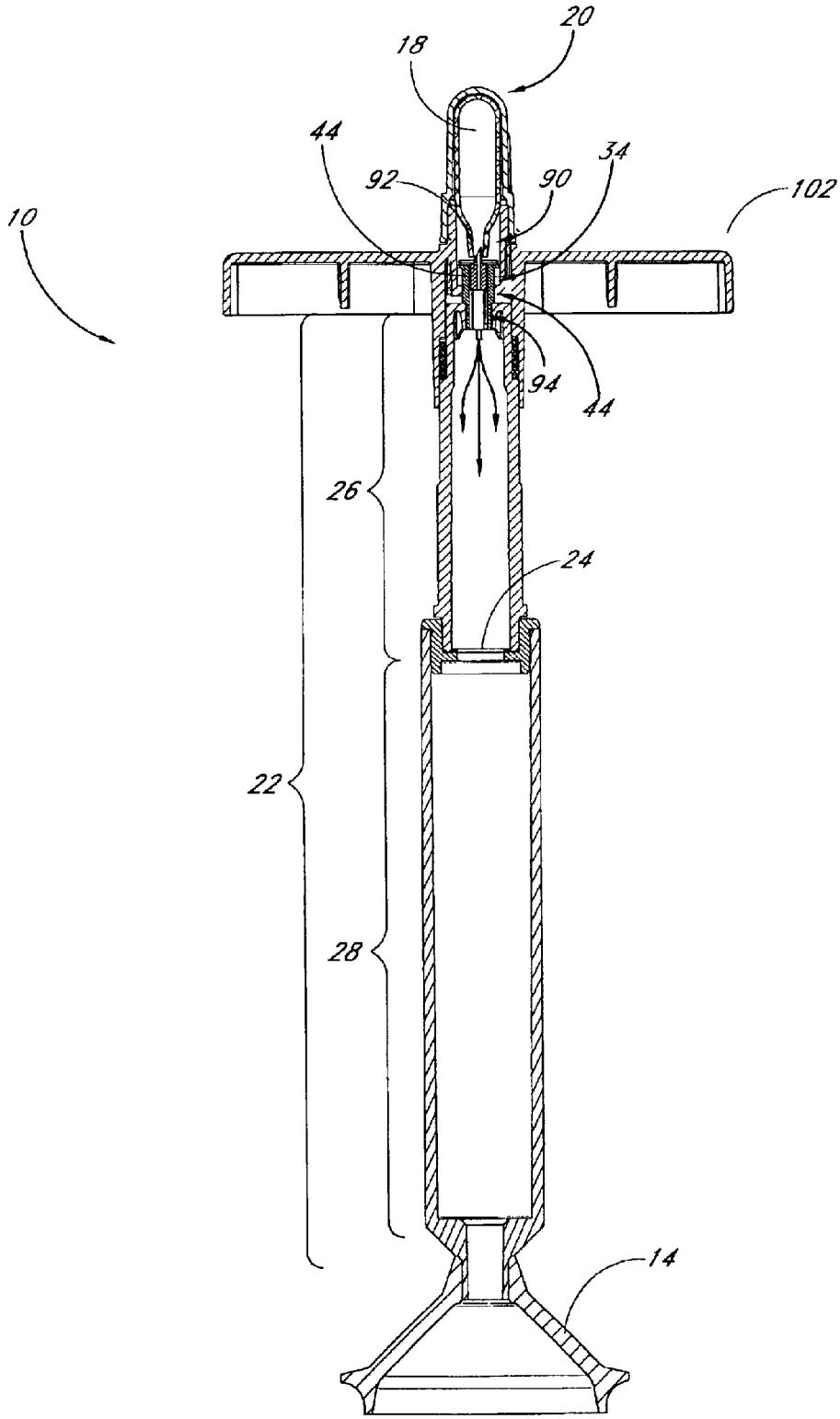
FIG. 19 is a cross-sectional elevation view of the plunger, similar to FIG. 15, wherein the handle is depressed and the canister is ruptured by a nozzle pin, wherein the compressed gas is shown escaping into the upper chamber of the plunger.

FIGS. 15 and 19 illustrate an embodiment of the plunger 10 without security triggers. This embodiment of the plunger 10 could employ a smaller handle 102 with a wingspan that is approximately 8 inches, which is shorter than the handle 12 by approximately 1.5 inches. This embodiment of the plunger 10 could also be molded such that the security triggers 16 could be manually installed onto and removed off of the handle. The plunger 10 without security triggers improves the ease by which the plunger may be used. For example, a handle without the security triggers could enable a person to operate the plunger with a single hand. In addition, the plunger may be operated with lower risk that the triggering mechanism will become stuck or broken. The advantages of having a handle without triggers also extend to lowering the manufacturing cost of the plunger and the efficiency by which the plunger can be manufactured.

Figure 6:
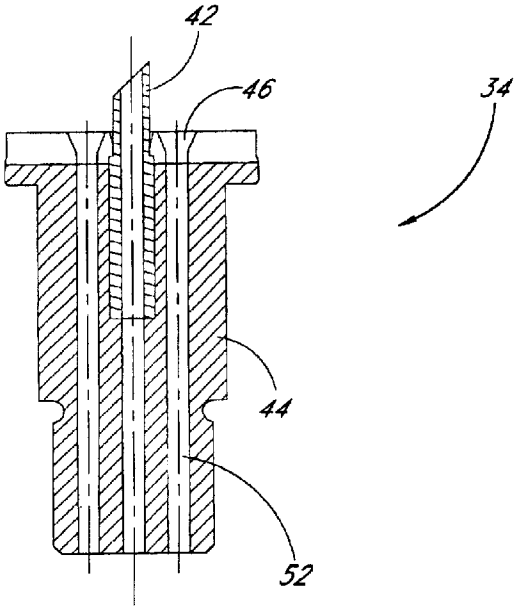
FIG. 6 is a cross-sectional elevation view of the nozzle, taken substantially along section plane 6—6 of FIG. 5, showing the gas pathway through the nozzle and pin.
Figure 7:
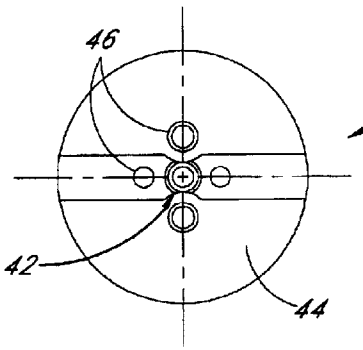
FIG. 7 is a top plan view of the nozzle, showing the top of the nozzle having at least two inlet holes for receiving the compressed gas from the canister.
Figure 5:
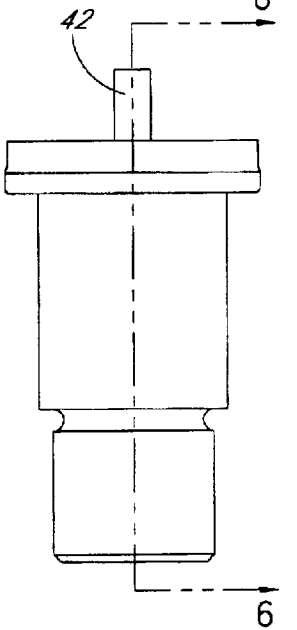
FIG. 5 is an elevation view of the nozzle.

One embodiment of nozzle 34 is shown in greater detail in FIGS. 5–7. The nozzle 34 has a piercing pin 42 preferably positioned near the center of the nozzle. The nozzle casing 44 is preferably composed of brass or zinc die cast and may be attached to the upper chamber 26 by a threaded connection. Alternatively, the nozzle casing 44 could be attached by interference fit. The pin 42 is preferably composed of hardened stainless steel and is staked into the nozzle casing 44, but could be attached by threaded connection or other appropriate means. Gas inlet holes 46 are provided in the pin 42 and in the nozzle casing 44 around the pin, as shown in FIG. 7, for receiving and directing the compressed gas into passages 52 within the nozzle casing 44, as shown in FIG. 6. The gas is transferred through the passages 52 from the pin end of the nozzle to the opposite end of the nozzle, which communicates with the upper chamber, as shown in FIG. 4A.

Figure 16:
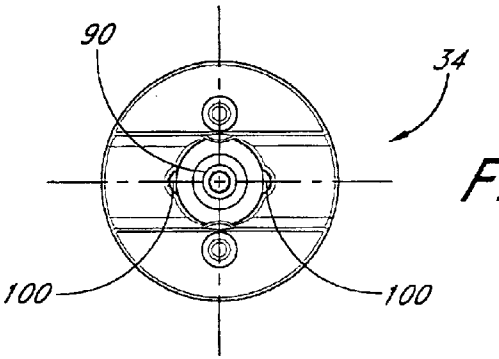
FIG. 16 is a top plan view of an alternative embodiment of the nozzle with two semi-circular inlet holes along the perimeter edge of the piercing pin casting.
Figure 17:
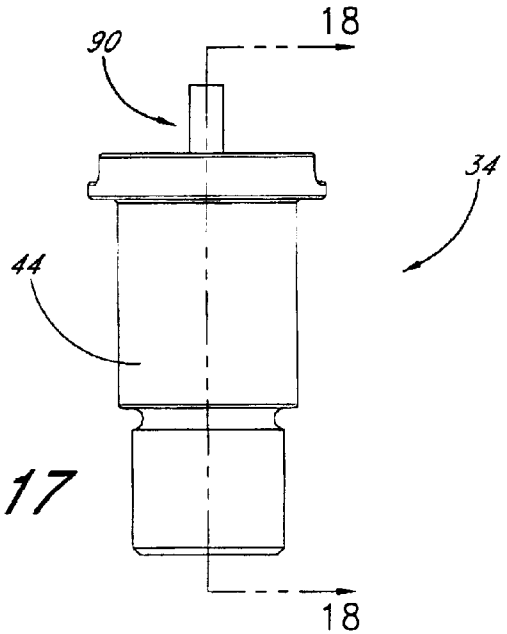
FIG. 17 is an elevation view of the nozzle of FIG. 16.
Figure 18:
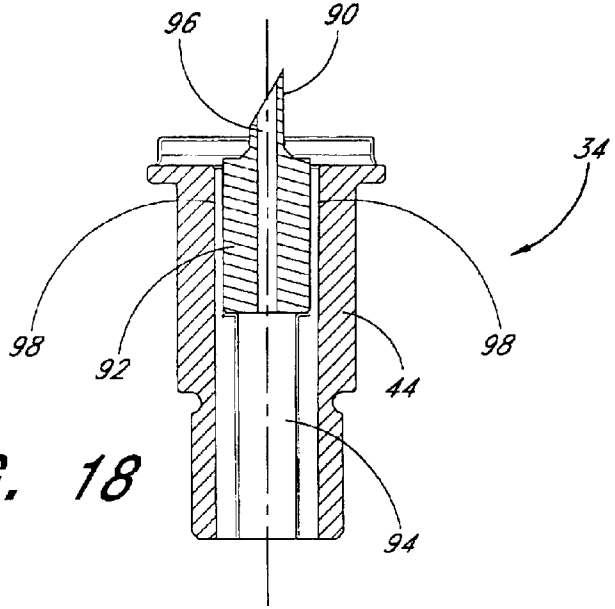
FIG. 18 is a cross-sectional view of the nozzle of FIG. 17, taken substantially along section plane 18—18 of FIG. 17, showing the gas pathway through the nozzle and pin.

An alternative embodiment of the nozzle 34 is shown in greater detail in FIGS. 16–18. The nozzle 34 has a piecing pin 90 preferably positioned near the center of the nozzle. The nozzle 34 is preferably composed of brass or zinc die cast and may be attached to the upper chamber 26 by a threaded connection. Alternatively, the nozzle 34 could be attached by an interference fit. The pin 90 is preferably composed of hardened stainless steel and has a diameter of approximately 0.100 inches. The pin 90 is nestled or integral with a pin base 92, which has a diameter of approximately 0.250 inches. The nozzle 34 preferably has a central passage 94 having a diameter of approximately 0.252 inches for receiving the pin base 92. The pin base 92 is staked into the nozzle casing 44, but could be attached by a threaded connection or other appropriate means.

A gas inlet channel 96 is provided in and runs the length of the pin 90 and base 92, as shown in FIG. 18, for receiving and directing the compressed gas into the passage 94 within the nozzle casing 44. The gas is transferred from the pin 90 to the passage 94 where the gas moves through an opening at the bottom end of the nozzle, which communicates with the upper chamber, as shown in FIG. 19.

The passage 94 preferably has channels 98 along its sides, as shown in FIG. 18. These channels 98 provide additional gas inlet holes 100, as shown in FIG. 16 for receiving and directing the compressed gas into the passage 94. Although the channels 98 preferably extend the full length of the passage 94, the channels may extend to a length which is equal to or slightly longer (e.g. 0.44 inches) than the pin base 92. The pin base 92 may alternatively have groves (not shown) along the length of the pin base that correspond to the channels 98. These groves act to further assist the receiving and directing of compressed air from the compressed gas cartridge to the upper chamber 26.

Figure 8:
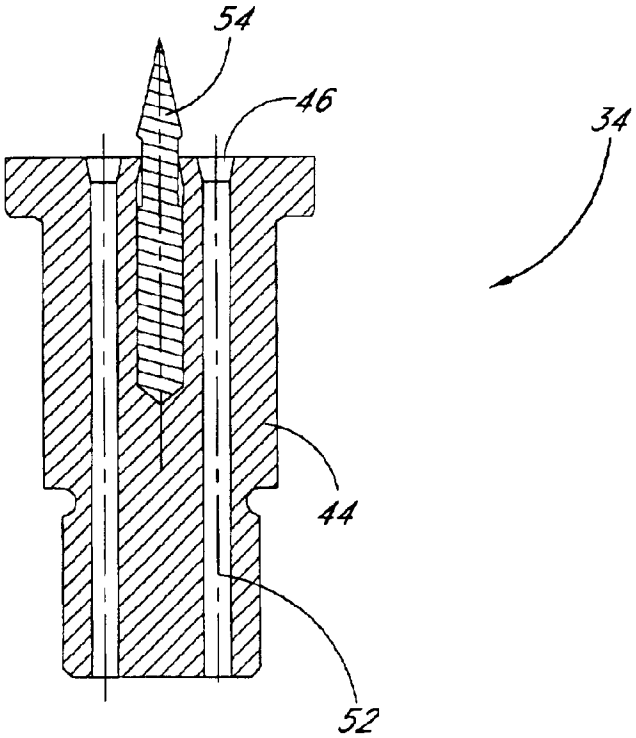
FIG. 8 is a cross-sectional elevation view of an alternative embodiment of the nozzle, shown in FIG. 6, with the gas pathway through the nozzle.

One skilled in the art can appreciate that any suitable device for puncturing the canister 18 and channeling the gas into the upper chamber 26 may be substituted for the nozzle 34. For instance, the pin 42 could be substituted for a pin 54 without an inlet hole or a passage as depicted in FIG. 8. In addition, multiple pins could be substituted for the single pin or, alternatively, the passages 52 could be formed in the pin 42 itself, as opposed to around the pin. Furthermore, while the preferred embodiment utilizes a nozzle 34, one skilled in the art can appreciate that the disclosed nozzle is not necessary where a device, other than a canister 18, is used for delivering a compressed gas to the plunger 10. For instance, a pump for delivering a compressed gas could be substituted for the canister 18, which would not require the use of the nozzle 34.

The plunger 10 is operated by gripping the handle 12 with both hands and positioning the plunger at the opening of a drain so as to create a secure connection between the sealing member 14 and the drain. Depending on the situation, the sealing member 14 may be oriented in the position shown in FIG. 3 or FIG. 4A. Once the plunger 10 is properly positioned, the security triggers 16 may then be compressed to rotate the positive stops 38 away from the travel path and to allow the handle 12 to be moved toward the chamber 22 for piercing the canister 18 by the nozzle 34, as shown in FIG. 4A. Piercing the canister 18 will cause the compressed gas to rush into the inlet holes 46 and through the passages of the nozzle 34 and pin 42, and into the upper chamber 26 wherein the energy of the gas may be harnessed and stored momentarily by the burst disk 24. After a sufficient amount of energy is harnessed, the burst disk 24 will rupture, propelling the energy of the gas through the lower chamber 28, as shown in FIG. 4B, out from the sealing member 14, and into the clogged drain to forcibly act against an obstruction.

The capacity of the burst disk 24 to harness energy in the upper chamber 26 is primarily a function of the thickness and material composition of the disk. While the burst disk 24 is preferably a disposable thin flat polymer having a substantially uniform thickness, which is calibrated to burst substantially instantaneously when the pierced canister releases pressurized gas into the upper chamber 26, the burst disk 24 may be composed of other suitable materials, such as composites or metals. Although the thickness of the burst disk 24 in this embodiment is preferably between about 0.007 to 0.021 inches, a burst disk with a thickness greater than this range will not adversely affect the ability of the plunger 10 to effectively remove obstructions from a clogged drain. In addition, placing multiple burst disks between the upper and lower chambers 26, 28, simulating the effect of a thicker burst disk, will generally increase the amount of harnessed energy directed to clear the obstruction from the clogged drain. In one embodiment, each disk 24 has a thickness of approximately 0.007 inches, a tensile strength of approximately 4500 psi, and a diameter of approximately 1.28 inches.

The preferred embodiment utilizes a plastic burst disk 24 that has a relatively smooth, planar surface with a substantially uniform thickness. There are advantages of using a burst disk 24 having this structure and composition. For example, a metallic disk having an uneven thickness, or a surface with scoring or other intentional surface discontinuity, may lead to a premature rupture event, which will cause a loss in the capacity for the burst disk to harness sufficient energy to clear a clogged drain. In contrast, a burst disk that is not scored and has a relatively even surface with a substantially uniform thickness is more readily available and is easier and less costly to manufacture. Moreover, the burst disk 24 of the preferred embodiment will rupture completely and substantially instantaneously when the pressure in the upper chamber 26 reaches a predetermined level. This causes the pressurized gas in the lower chamber 28 to exit in a huge "burst" that is sudden and powerful. As a result, the force acting against the obstruction in the drain is maximized.

A ruptured burst disk 24 may be replaced by detaching the upper chamber 26 from the lower chamber 28 and removing the ruptured disk from the lower chamber. After the ruptured disk 24 is removed, a new disk or disks may be placed above a washer 48, which is secured to the lower chamber 28. The washer 48 is preferably made from a soft die-cut polymer, which provides support for the burst disk 24 and a good sealing connection between the lower and upper chambers 26, 28 when they are attached together. While the washer 48 may be adhered to the lower chamber 28, it could alternatively have a press fit diameter. After the new burst disk 24 or disks are properly positioned, the lower and upper chambers 26, 28 may be re-connected. The two chambers 26, 28 may be attached together by a threaded connection or interference fit. However, as one in the art may appreciate, any suitable means may be used for attaching the two chambers 26, 28, such as fastening hooks or grapplers, so long as the connection between the two chambers is secure enough to maintain the connection and prevent escaping gases.

A webbed or screened discharge outlet 50 may be provided between the sealing member 14 and lower chamber 28 to prevent the propelling of solid debris from the chamber 22. Because it is possible for an operator to load the upper chamber 26 with projectiles such as rocks, bullets or pellets, and then use the force of the compressed gas to catapult the elements toward another person or object, the webbed discharge outlet 50 also serves as a safety measure to help avoid both accidents and intentional tortious acts. However, as one skilled in the art can appreciate, the webbed discharge outlet 50 is not necessary for the proper operation of the plunger 10 for clearing drains.

Figure 9:
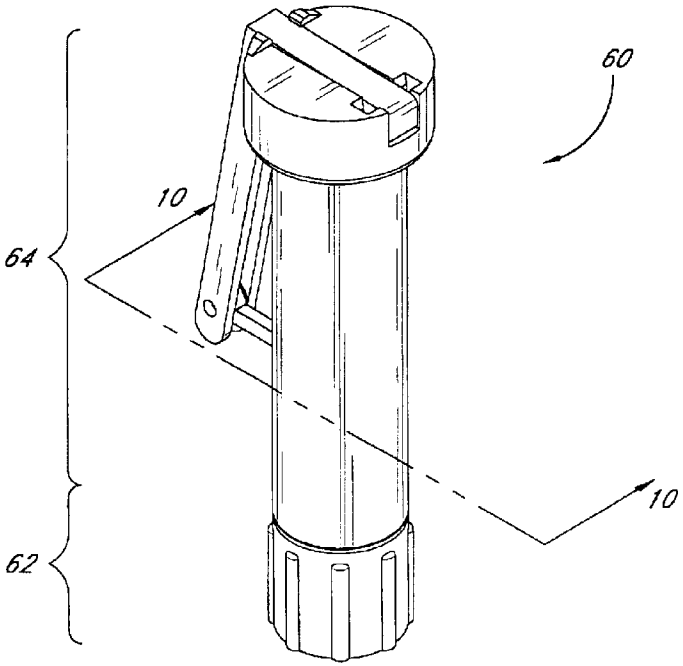
FIG. 9 is a perspective view of an alternative embodiment comprising a one-handed grip for use with the plunger.

In another embodiment, the air burst drain plunger may be operated by a one-handed grip 60 as shown in FIGS. 9–12, to provide the flexibility of operating the plunger 10 with one hand and in areas of restricted access where a two handed operation is difficult or impossible. The one-handed grip 60, as shown in FIG. 9, comprises an adapter 62 and an assembly 64.

The assembly 64 comprises a receptacle 66, lever 68, and drive pin 70. The receptacle 66 has an inner cavity 72 with an opening on one end adapted for receiving the drive pin 70 and is threaded on the other end for receiving the adapter 62. The lever 68 is connected to the receptacle 66 and adapted to rotate so as to force the drive pin 70 through the opening and into the inner cavity 72.

The adapter 62 is designed to be disposed between the upper chamber 26 and assembly 64 and to connect the plunger with the assembly by means of a threaded connection. As one skilled in the art can appreciate, however, the one-handed grip 60 could be connected to the plunger 10 by an interference fit, brackets, latches, or other suitable means. The adapter 62 is comprised of a casing 74, nozzle 34, spring 76, and sleeve 78. The nozzle 34 is the same nozzle described above and as shown in FIGS. 5–8. The casing 74 is hollow with a small opening 80 in the middle for receiving the nozzle 34 and is preferably connected to the casing by a threaded connection, but could be connected to the casing by interference fit. Before the nozzle 34 is connected to the casing 74, the spring 76 is placed in the upper hollow of the casing and the sleeve 78 is placed on one end of the spring away from the center of the casing. The nozzle 34 is then secured to the casing 74 which holds the spring 76 and sleeve 78 in alignment for receiving the canister 18. The spring 76 is biased to force the sleeve 78 away from the center for the casing 74.

Figure 11:
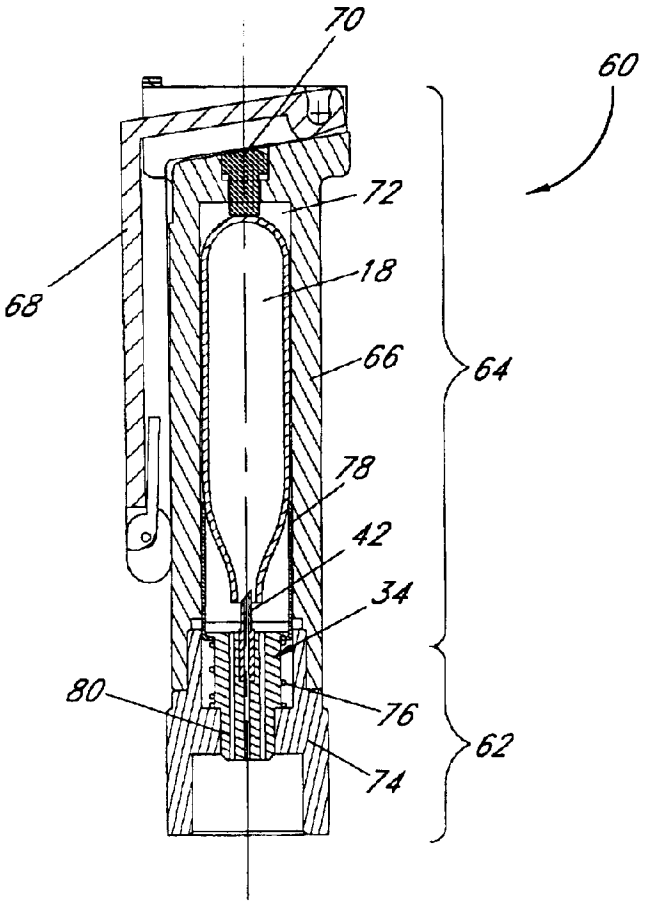
FIG. 11 is a cross-sectional elevation view similar to FIG. 10 showing the one-handed grip in operation.
Figure 10:
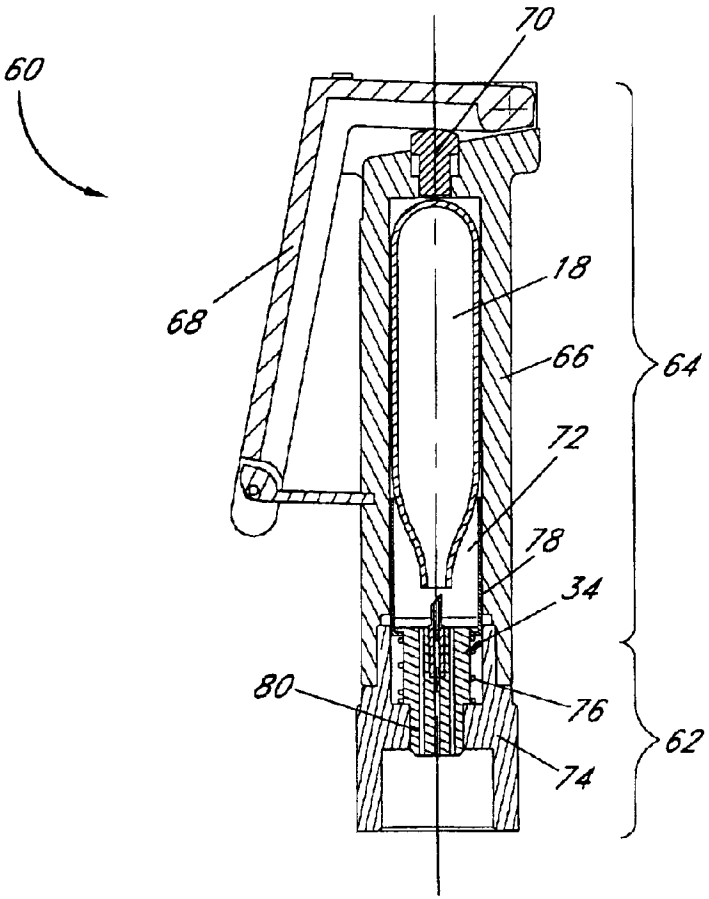
FIG. 10 is a cross-sectional elevation view of the one-handed grip taken substantially along section plane 10—10 of FIG. 9.

With reference to FIGS. 10 and 11, the one-handed grip plunger 82 is operated by rotating or squeezing the lever 68 toward the receptacle 66. As the lever 68 is drawn into contact with a side of the receptacle 66, the drive pin 70 is forced into the inner cavity 72 pushing the canister 18 against the sleeve 78 and into the pin 42 on the nozzle 34. When the canister 18 is pushed into the pin 42, the pin will pierce the canister sending gas into the upper chamber 26 of the plunger 82 causing the burst disk 24 to rupture, which will send a sudden burst of energy through the lower chamber 28 and out the sealing member 14. The canister is replaced by unfastening the assembly 64 from the adapter 62, removing the pierced canister, placing a new canister on the end of the sleeve 78, and refastening the assembly to the adapter.

Figure 12:
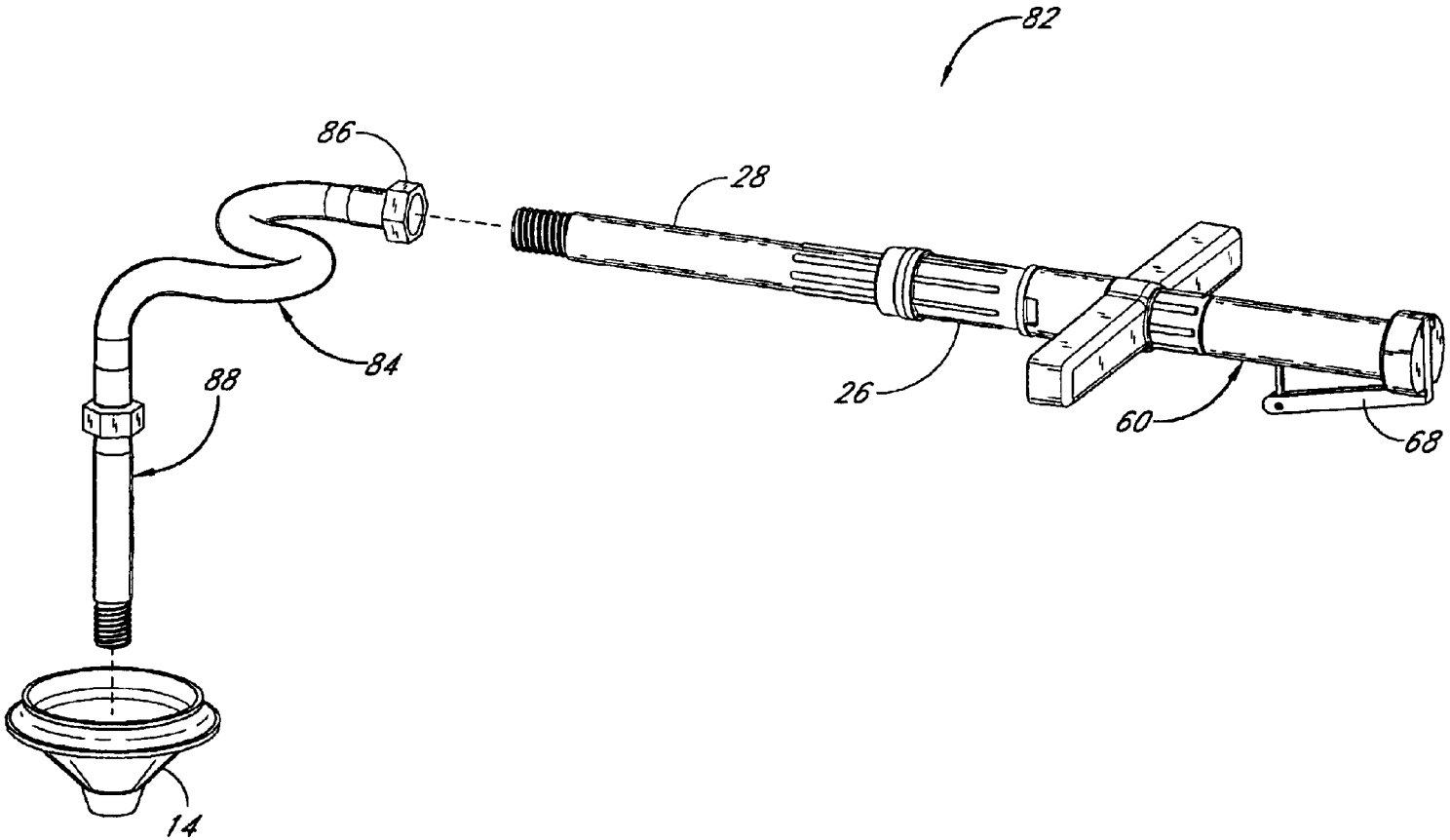
FIG. 12 is a perspective view of another embodiment of the plunger with the one-handed grip and a flexible hose coupling the reversible sealing member to the plunger.
Figure 13:
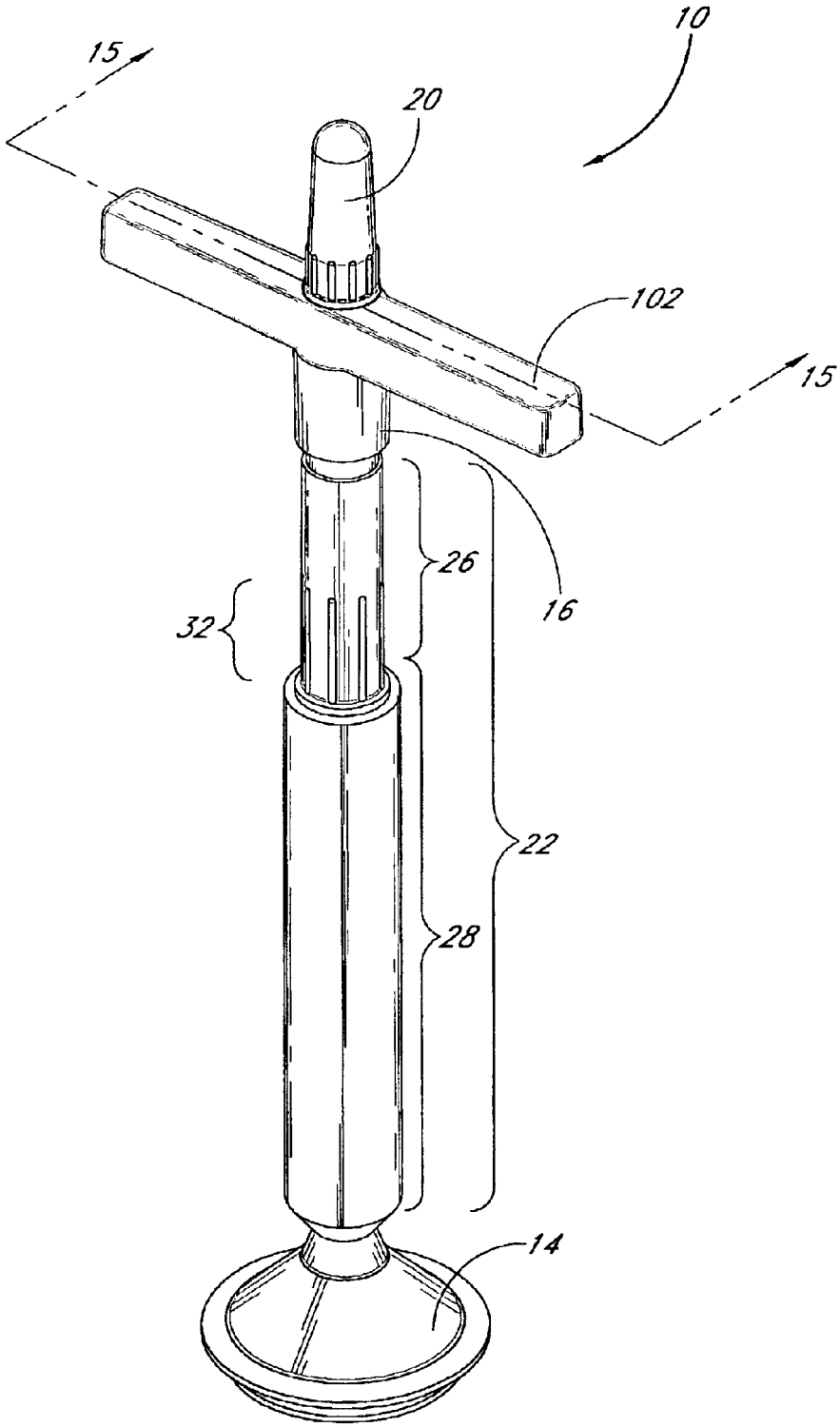
FIG. 13 is a perspective view of an alternative embodiment of the air-burst drain plunger having a lower chamber having a wider diameter.
Figure 14:
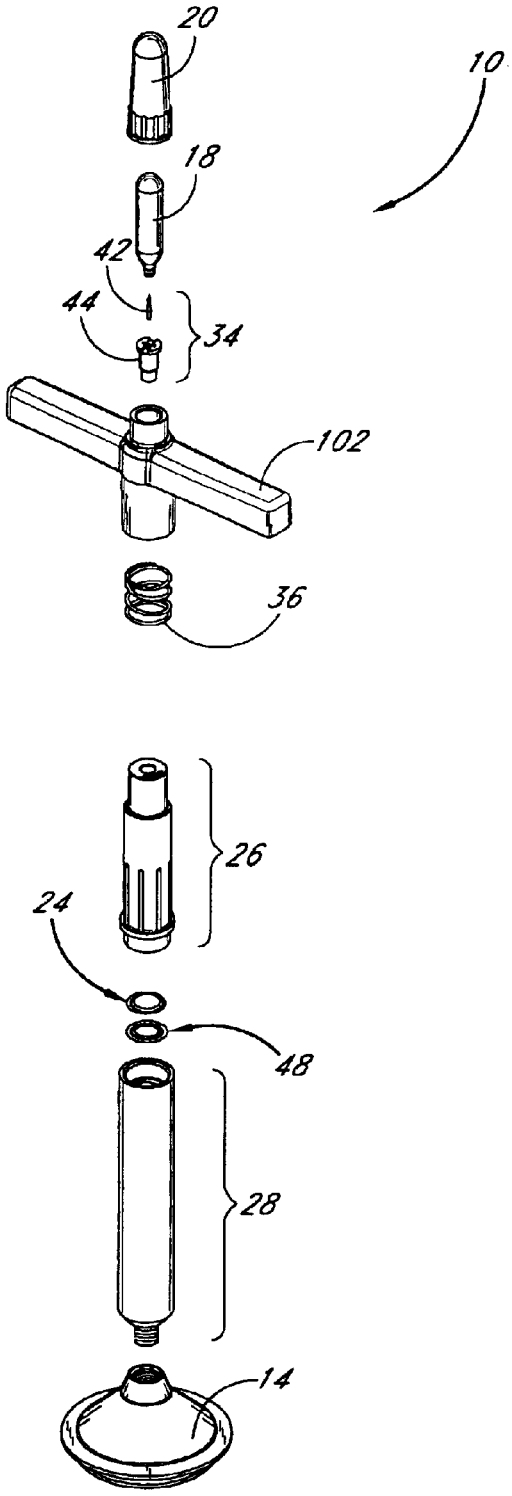
FIG. 14 is an assembly view of the plunger of FIG. 13.

In an alternative embodiment, a flexible hose 84 may be interposed between the sealing member 14 and the lower chamber 28 as shown in FIG. 12 for providing a user with the added flexibility of orienting the sealing member 14 in a number of directions or positions for creating a secure connection between the plunger 82 and the drain. The flexible hose 84 is preferably about ½ inch in diameter, about eighteen inches long, and is threaded or has threaded couplings 86 on each end. The hose 84 may be attached to the lower chamber 28 by interference fit, however, the hose preferably will be threaded to the chamber. The hose is preferably attached to the sealing member 14 through the use of a PVC pipe 88. The pipe 88 is provided for a user to direct the positioning of the sealing member 14 and to hold the sealing member in place during operation of the plunger 82. The pipe 88 is preferably about five inches long and is fastened to the hose by a threaded connection. The sealing member 14 is attached to the pipe 88 by interference fit or a threaded connection. While the pipe 88 is helpful in guiding the position of the sealing member 14, one skilled in the art can appreciate that the pipe is not necessary for the operation of the plunger 82.

Although the foregoing invention has been described in terms of certain preferred embodiments, other embodiments will become apparent to those of ordinary skill in the art, in view of the disclosure herein. Accordingly, the present invention is not intended to be limited by the recitation of preferred embodiments, but is instead to be defined solely by reference to the appended claims.

What is claimed is:

1. A plunger for clearing a clogged drain, comprising:

a chamber having an upper end, a lower end, and an inner cavity for receiving a compressed gas through an opening adjacent the upper end of the chamber;

a sealing mechanism adjacent the lower end of the chamber for connecting the plunger to a drain opening;

a nozzle connected to the upper end of the chamber;

a handle connected to and axially moveable with respect to the upper end of the chamber;

a compressed gas canister connected for movement with the handle and having a puncture point spaced from and in substantially axial alignment with a pin on the nozzle; and a burst disk within the inner cavity between the upper and lower ends of the chamber for providing a temporary barrier to accumulate pressure within the inner cavity, said burst disk divides said chamber into an upper chamber and a lower chamber, wherein the inner cavity of the upper chamber has a smaller volume than the inner cavity of the lower chamber, wherein the burst disk is adapted to burst when the pressure in the chamber reaches a predetermined level, to thereby send a sudden burst of gas and energy into the drain.

2. The plunger of claim 1, wherein the burst disk is constructed of a substantially non-metallic material.

3. The plunger of claim 1, further comprising a compression spring positioned between the chamber and the handle for normally biasing the handle away from the chamber.

4. The plunger of claim 1, further comprising a piercing pin positioned on one end of the nozzle.

5. The plunger of claim 4, wherein the piercing pin is staked to the nozzle and positioned near the center of the nozzle.

6. The plunger of claim 4, further comprising a gas inlet hole in the piercing pin for receiving and directing gas into the nozzle.

7. The plunger of claim 6, wherein the nozzle has a passage which extends through the nozzle for receiving gas from the gas inlet hole of the piercing pin.

8. The plunger of claim 7, wherein the passage is cylindrical and positioned near the center of the nozzle and has a diameter that is sized for receiving the piercing pin.

9. The plunger of claim 8, wherein the passage has channels along the length of the cylindrical sides of the passage for receiving and directing gas into the passage.

10. A plunger for clearing a drain, comprising:

a chamber having an upper end and a lower end;

a nozzle adjacent the upper end of the chamber for receiving a compressed gas;

a sealing member adjacent the lower end of the chamber for providing a connection between the plunger and a drain opening;

a burst disk within the chamber that divides the chamber into an upper chamber and a lower chamber, wherein the lower chamber has a larger volume than the upper chamber, and wherein the burst disk is adapted to burst when the pressure in the upper chamber reaches a predetermined level.

11. The plunger of claim 10, wherein the burst disk is constructed of a substantially non-metallic material.

12. The plunger of claim 10, further comprising a piercing pin positioned on one end of the nozzle.

13. The plunger of claim 12, wherein the piercing pin is staked to the nozzle and positioned near the center of the nozzle.

14. The plunger of claim 12, further comprising a gas inlet hole in the piercing pin for receiving and directing gas into the nozzle.

15. The plunger of claim 14, wherein the passage extends through the nozzle for receiving gas from the gas inlet hole of the piercing pin.

16. The plunger of claim 15, wherein the passage is cylindrical and positioned near the center of the nozzle and has a diameter that is sized for receiving the piercing pin.

17. The plunger of claim 16, wherein the passage has channels along the length of the cylindrical sides of the passage for receiving and directing gas into the passage.

18. The plunger of claim 10, wherein the sealing member and lower end of the chamber are joined by a threaded connection.

19. A method of clearing a drain using a plunger, having a handle, a nozzle, and a burst disk, that harnesses the energy of a compressed gas and directs that energy to the drain by means of a sudden burst of pressure, comprising:

placing the burst disk within an inner cavity of a chamber at a location between the nozzle and a discharge end of the plunger said burst disk divides said chamber into an upper chamber and a lower chamber, wherein the inner cavity of the upper chamber has a smaller volume than the inner cavity of the lower chamber;

connecting the discharge end of the plunger to a drain opening; and forcing the handle axially toward the burst disk to cause compressed gas from a pressurized canister to enter the nozzle and against the burst disk to cause the burst disk to rupture when the pressure against the burst disk reaches a predetermined level, to thereby send a sudden burst of pressure and energy into the drain.

20. The method of claim 19, wherein forcing the handle toward the burst disk punctures the canister and releases gas from the canister into the nozzle.

21. The method of claim 20, wherein the canister is punctured by a pin on the nozzle.

22. The method of claim 19, wherein placing the burst disk between the nozzle and the sealing member comprises:

disconnecting a chamber into two portions, an upper chamber connected to the nozzle and a lower chamber connected to the sealing member;

reconnecting the two portions the chamber.

23. The method of claim 19, further comprising, detaching a cover on the handle to gain access to a spent compressed gas canister;

replacing the spent canister with a new canister containing compressed gas; and reattaching the cover.

24. A plunger for clearing a drain, comprising:

a chamber having an upper end, a lower end, and an inner cavity for receiving a compressed gas through an opening adjacent the upper end of the chamber;

a nozzle having a passage for receiving a compressed gas, wherein the passage is cylindrical and positioned near the center of the nozzle having channels along the length of the cylindrical sides of the passage for receiving and directing the gas into the passage;

a sealing member connected to the nozzle for providing a connection between the plunger and a drain opening;

a burst disk positioned to create a barrier between the nozzle and sealing member said burst disk divides said chamber into an upper chamber and a lower chamber, wherein the inner cavity of the upper chamber has a smaller volume than the inner cavity of the lower chamber, wherein the burst disk is adapted to burst when the pressure between the barrier and the top of the nozzle reaches a predetermined level, to thereby send a sudden burst of gas and energy into the drain.

* * * * *

UNITED STATES PATENT AND TRADEMARK OFFICE

CERTIFICATE OF CORRECTION

PATENT NO. : 6,922,854 B2
DATED : August 2, 2005
INVENTOR(S) : Allenbaugh et al.

It is certified that error appears in the above-identified patent and that said Letters Patent is hereby corrected as shown below:

Column 2,
Line 1, delete “Knobb” and insert -- Knobbe --.

Column 11,
Line 52, after “plunger”, insert -- , --.

Column 12,
Line 22, after “member;” insert -- and --.
Line 23, after “portions” insert -- of --.
Line 24, after “comprising” delete “,” and insert -- : --.

Signed and Sealed this

Twenty-eighth Day of February, 2006

JON W. DUDAS
*Director of the United States Patent and Trademark Office*